US010978086B2

(12) United States Patent
Wung et al.

(10) Patent No.: US 10,978,086 B2
(45) Date of Patent: Apr. 13, 2021

(54) ECHO CANCELLATION USING A SUBSET OF MULTIPLE MICROPHONES AS REFERENCE CHANNELS

(71) Applicant: Apple Inc., Cupertino, CA (US)

(72) Inventors: Jason Wung, Cupertino, CA (US); Sarmad Aziz Malik, Cupertino, CA (US); Ashrith Deshpande, Cupertino, CA (US); Ante Jukic, Los Angeles, CA (US); Joshua D. Atkins, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/517,400

(22) Filed: Jul. 19, 2019

(65) Prior Publication Data

US 2021/0020188 A1 Jan. 21, 2021

(51) Int. Cl.

| | |
|---|---|
| ***G10L 21/0208*** | (2013.01) |
| ***G10K 11/178*** | (2006.01) |
| *G10L 21/0216* | (2013.01) |

(52) U.S. Cl.

CPC ..... *G10L 21/0208* (2013.01); *G10K 11/178* (2013.01); *G10L 2021/02082* (2013.01); *G10L 2021/02166* (2013.01)

(58) Field of Classification Search

CPC ..... G10L 2021/02082; G10L 15/22; G10L 21/0208; G10L 2015/223; G10L 25/84;

(Continued)

(56) References Cited

U.S. PATENT DOCUMENTS 4,959,857 A * 9/1990 Erving ..... H04M 9/085 379/388.05

5,329,472 A 7/1994 Sugiyama (Continued)

FOREIGN PATENT DOCUMENTS

WO WO2015157013 A1 10/2015

OTHER PUBLICATIONS

U.S. Patent Application for Related U.S. Appl. No. 15/223,978, filed Jul. 29, 2016.

(Continued)

*Primary Examiner* — Kile O Blair

(74) *Attorney, Agent, or Firm* — Womble Bond Dickinson (US) LLP

(57) ABSTRACT

An echo canceller is disclosed in which audio signals of the playback content received by one or more of the microphones from a loudspeaker of the device may be used as the playback reference signals to estimate the echo signals of the playback content received by a target microphone for echo cancellation. The echo canceller may estimate the transfer function between a reference microphone and the target microphone based on the playback reference signal of the reference microphone and the signal of the target microphone. To mitigate near-end speech cancellation at the target microphone, the echo canceller may compute a mask to distinguish between target microphone audio signals that are echo-signal dominant and near-end speech dominant. The echo canceller may use the mask to adaptively update the transfer function or to modify the playback reference signal used by the transfer function to estimate the echo signals of the playback content.

22 Claims, 5 Drawing Sheets

(58) Field of Classification Search
CPC ..... G10L 21/0216; G10L 25/78; G10L 15/20; G10L 2021/02161; G10L 2021/02168; G10L 21/02; G10L 21/0272; G10L 21/028; H04R 3/005; H04R 1/406; H04R 3/02; H04R 29/005; H04R 2410/01; H04R 2410/05; H04R 2499/11; H04M 9/082; H04M 3/002; H04M 9/08; H04M 1/20; G06F 3/167; G10K 2210/3028; G10K 2210/505; G10K 11/17823; G10K 11/17881
See application file for complete search history.

(56) References Cited

U.S. PATENT DOCUMENTS

| | | | | |
|---|---|---|---|---|
| 5,737,485 | A | 4/1998 | Flanagan | |
| 7,583,808 | B2 | 9/2009 | Smaragdis | |
| 8,260,442 | B2 | 9/2012 | Christensen | |
| 8,345,890 | B2 * | 1/2013 | Avendano | G10L 21/0208 381/94.3 |
| 8,660,281 | B2 | 2/2014 | Bouchard | |
| 9,100,466 | B2 * | 8/2015 | Yemdji | H04M 9/082 |
| 10,045,122 | B2 * | 8/2018 | Shah | H04R 3/005 |
| 2006/0155346 | A1 | 7/2006 | Miller, III | |
| 2008/0101622 | A1 | 5/2008 | Sugiyama | |
| 2009/0181637 | A1 | 7/2009 | Mueller-Weinfurtner | |
| 2009/0192803 | A1 | 7/2009 | Nagaraja | |
| 2010/0198598 | A1 | 8/2010 | Herbig | |
| 2015/0063581 | A1 | 3/2015 | Tani | |
| 2015/0104030 | A1 | 4/2015 | Ueno | |
| 2015/0112672 | A1 | 4/2015 | Giacobello | |
| 2016/0022991 | A1 | 1/2016 | Apoux | |
| 2016/0322055 | A1 | 11/2016 | Sainath | |

OTHER PUBLICATIONS

A study of QR decomposition and Kalman Filter implementations, by David Fuertes Roncero; Master's Degree Project; Stockholm, Sweden Sep. 2014; Kungliga Tekniska Hgskolan Electrical Engineering; 73 Pages (XR-EE-SB 2014:010).

* cited by examiner

ECHO CANCELLATION USING A SUBSET OF MULTIPLE MICROPHONES AS REFERENCE CHANNELS

FIELD

This disclosure relates to the field of audio communication devices; and more specifically, to processing methods designed to cancel echo signals of audio content played from a communication device by using a subset of a microphone array of the communication device as reference channels. Other aspects are also described.

BACKGROUND

Consumer electronic devices such as smartphones, desktop computers, laptops, home assistant devices, etc., may play audio content and sense audio input such as user speech. Increasingly, users may control or interact with these devices through voice commands. For example, a user may issue voice commands to a smartphone to make phone calls, send messages, play media content, obtain query responses, get news, setup reminders, etc. In some scenarios, a user may issue a voice command while the smartphone is outputting audio playback signals such as music, podcast, speech, etc., from one or more loudspeakers on the smartphone. Echo signals from the audio playback output may be picked up along with the sound of the voice command by one or more microphones of the device. The echo signals may interfere with speech recognition of the voice command signal, causing the smartphone to misinterpret the voice command.

SUMMARY

A user may issue voice commands to smartphones, smart assistant devices, or other media devices. A device may have multiple microphones at different locations on the device to receive voice commands from, and also multiple loudspeakers at different locations to output audio content to, a user who may be at different positions and directions with respect to the device. The multiple loudspeakers may play identical audio content, or may play different channels of the audio content, such as multi-channel stereo music. Echo signals of the audio playback output from the loudspeaker may be received by any one of the microphones. The characteristics of the echo signals received by the multiple microphones may be different due to the microphones' different positions and distances from the loudspeakers and due to the acoustic environment of the device. When a user issues a near-end voice command while the loudspeakers are playing the audio content in a process known as barge-in, the echo signals may interfere with the voice command signal received by the microphones. Speech recognition software running on the device or on a remote server connected to the device may not be able to detect the voice command signal or may misinterpret the voice command signal due to the echo signal interference. Thus, it is desirable for echo cancellation or suppression of the audio content signals received by the microphones.

Existing methods for echo cancellation use the signal of the playback content provided to a loudspeaker as a playback reference signal to estimate the echo signal of the audio content played from that loudspeaker received by a microphone. The echo canceller may estimate the transfer function or impulse response between the loudspeaker and the microphone due to the acoustic environment based on the loudspeaker playback reference signal and the microphone signal. The echo canceller may estimate the echo signal of the playback content received by the microphone based on the playback reference signal of the loudspeaker and the estimated transfer function for the loudspeaker-microphone pair. The echo signals from multiple loudspeakers received by the microphone may be estimated. The echo canceller may subtract the estimated echo signals from the signal received by the microphone to cancel or suppress the echo signals of the playback content output by the one or more loudspeakers from the voice command signal. However, using the playback content provided to the loudspeaker as a playback reference signal to estimate the transfer function and to estimate the echo signals from the loudspeaker to the microphone may not capture the nonlinearities of the loudspeaker. The playback reference signals provided to the loudspeakers and the signal received by the microphone also may be on different clock domains, introducing clock-synchronization issues and degrading the performance of the echo canceller.

To provide an echo canceller that captures speaker nonlinearities and eliminates clock-synchronization issues, the audio signals of the playback content received by one or more of the microphones of the device may be used as the playback reference signals to estimate the echo signals of the playback content received by a target microphone targeted for echo cancellation. The echo canceller may estimate the transfer function or impulse response between a reference microphone and the target microphone due to the acoustic environment based on the playback reference signal of the reference microphone and the signal of the target microphone. The echo canceller may estimate the echo signal of the playback content received by the target microphone from a loudspeaker based on the playback reference signal of the reference microphone and the estimated transfer function of the reference microphone-target microphone pair. One or more of the microphones on the device may be designated as reference microphones to provide the playback reference signals. The echo canceller may estimate the echo signals of the playback content received by the target microphone from multiple loudspeakers based on the playback reference signals of multiple reference microphones. The geometry of the array of microphones is fixed to facilitate echo signal estimation. To achieve fast initial echo cancellation convergence, the transfer function between the reference microphone and target microphone may be pre-initialized using anechoic, white noise recordings.

Because a reference microphone rather than a loudspeaker is used to provide the playback reference signal, near-end voice command from a user during barge-in may also be received by the reference microphone. To mitigate potential near-end speech cancellation at the target microphone, the echo canceller may compute a double-talk detection mask to distinguish between target microphone audio signals that contain predominantly echo signals of the playback content and those that contain predominantly a near-end speech signal. The echo canceller may use the double-talk detection mask to control how the transfer function is updated. In one embodiment, the echo canceller may update the transfer function when the double-talk detection mask indicates the echo signal component is dominant. Alternatively, the echo canceller may decide not to update the transfer function when the double-talk detection mask indicates the near-end speech component is dominant. For example, the echo canceller may use the double-talk detection mask of a reference microphone-target microphone pair as a step-size control to control updating of the multi-delay filter (MDF)

used to calculate the transfer function between the reference microphone-target microphone pair. In one embodiment, the echo canceller may use the double-talk detection mask to remove the near-end speech component from the signals of the reference microphone used to estimate the transfer function of the reference microphone-target microphone pair. The echo canceller may subtract the estimated echo signals from the signal received by the target microphone to cancel or suppress the echo signals of the playback content from one or more loudspeakers.

A first method for echo cancellation using a microphone of a device as a reference channel to provide playback reference signals to estimate the echo signals of the playback content received by a target microphone is disclosed. The method includes receiving a reference audio signal captured by the reference microphone where the reference audio signal is responsive to sound from a loudspeaker of the device. The method also includes receiving a target audio signal captured by the target microphone of the device, where the target audio signal is responsive to an echo of the sound from the loudspeaker and to speech from a speech source. The method further includes computing a mask based on the reference audio signal and the target audio signal where the mask is a measure of a relative strength of the reference audio signal and the target audio signal. The method further includes adaptively estimating a transfer function between the reference microphone and the target microphone based on the mask, the reference audio signal, and the target audio signal. The method further includes determining an estimated echo component of the sound from the loudspeaker based on the estimated transfer function and the reference audio signal. The method cancels the estimated echo component from the target audio signal to generate an echo-cancelled signal.

A second method for echo cancellation using a microphone of a device as a reference channel to provide playback reference signals to estimate the echo signals of the playback content received by a target microphone is disclosed. The method includes receiving a reference audio signal captured by the reference microphone where the reference audio signal is responsive to sound from a loudspeaker of the device. The method also includes receiving a target audio signal captured by the target microphone of the device, where the target audio signal is responsive to an echo of the sound from the loudspeaker and to speech from a speech source. The method further includes determining a mask based on the reference audio signal and the target audio signal where the mask is a measure of a relative strength of the reference audio signal and the target audio signal. The method further includes modifying the reference audio signal based on the mask to generate a modified reference audio signal. The method further includes adaptively estimating a transfer function between the reference microphone and the target microphone based on the modified reference audio signal and the target audio signal. The method further includes determining an estimated echo component of the sound from the loudspeaker based on the estimated transfer function and the modified reference audio signal. The method further includes canceling the estimated echo component from the target audio signal to generate an echo-cancelled signal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
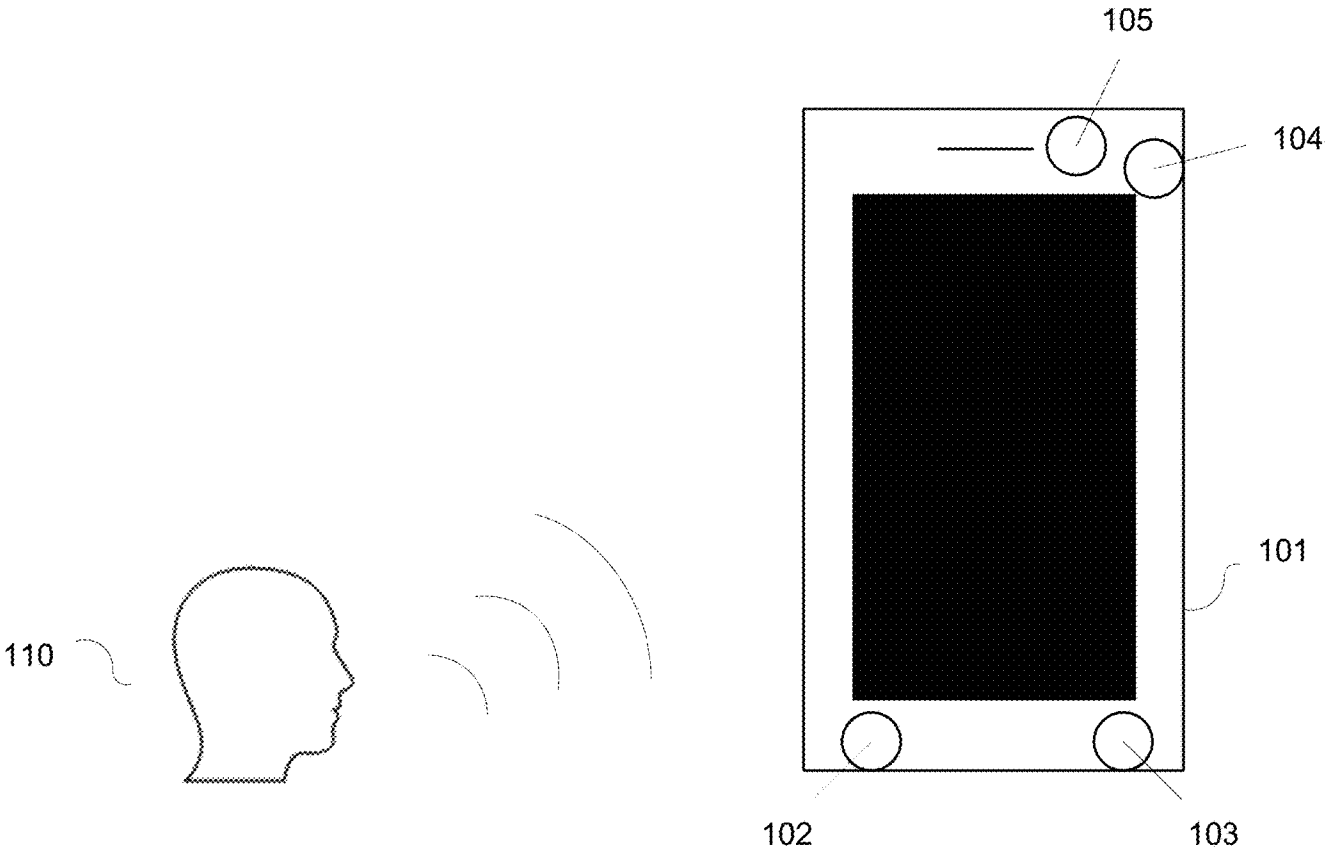
FIG. 1 depicts a scenario of a user interacting with a smartphone wherein the microphone uses a subset of a microphone array as reference channels for echo cancellation according to one embodiment of the disclosure.

Systems and methods are disclosed for an echo canceller that uses a subset of microphones of a device as reference channels to provide playback reference signals to estimate the echo signals of audio playback content received by another microphone. For example, one or more microphones that are relatively close to one or more loudspeakers on the device and that are relatively susceptible to residual echo of playback content output from the loudspeakers may be designated as reference microphones. The audio signals from the reference microphones are used as the playback reference signals to estimate the echo signals of the playback content received by another microphone less susceptible to residual echo, referred to as a target microphone. The echo canceller may estimate the transfer function, also referred to as the impulse response, between a pair of reference microphone and target microphone by processing the playback reference signal from the reference microphone and the audio signal from the target microphone. When a near-end user speaks or issues a voice command during playback of audio content from the loudspeakers, the reference microphone as well as the target microphone may capture the near-end speech. To mitigate potential cancellation of the near-end speech, the echo canceller may compute a discriminator value, referred to as a double-talk mask or simply a mask, to measure the relative strength of the echo signal component and the near-end speech component of the signals captured by the reference microphone-target microphone pair. The echo canceller may adaptively modify the estimation of the echo signal for echo cancellation of the signal captured by the target microphone based on the mask.

In one embodiment, the echo canceller may implement a multi-delay filter (MDF) to estimate the transfer function between a reference microphone-target microphone pair. The MDF may be updated as the playback reference signal of the reference microphone and the echo characteristics of the playback content change. The echo canceller may use the mask as a step-size control to adaptively control the updating of the MDF. For example, if the mask indicates that the echo signal component of the playback content is dominant, the MDF may be updated to modify the transfer function to account for the echo signal component. Alternatively, if the mask indicates that the near-end speech component is dominant, the MDF may not be updated so that the transfer function does not consider the near-end speech component captured by the reference microphone so as to mitigate potential cancellation of the near-end speech at the target microphone.

In one embodiment, the echo canceller may implement a sub-band lattice filter. The lattice filter may calculate forward and backward prediction errors for the playback reference signal of the reference microphone. The mask may be used to enhance the playback reference signal by removing the near-end speech component from the forward and backward prediction errors for the sub-band lattice filter when the mask indicates that the near-end speech component is dominant. In one embodiment, the sub-band lattice filter may apply the mask on each stage of the lattice update to mitigate potential cancellation of the near-end speech at the target microphone.

In one embodiment, for fast initial echo cancellation convergence, the transfer function between the reference microphone and target microphone may be pre-initialized using anechoic, white noise recordings. In one embodiment, echo coupling of different target microphones may be different due to the microphones' different positions and distances from the loudspeakers and the acoustic environment. For example, when the device is set facing up on a table, a target microphone on the back of the device may experience high echo coupling. A deep neural network-based residual echo cancellation (DNN-REC) system may operate on the echo cancelled signal from the echo canceller to remove residual echo from each target microphone independently.

In the following description, numerous specific details are set forth. However, it is understood that aspects of the disclosure here may be practiced without these specific details. In other instances, well-known circuits, structures and techniques have not been shown in detail in order not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and "comprising" specify the presence of stated features, steps, operations, elements, or components, but do not preclude the presence or addition of one or more other features, steps, operations, elements, components, or groups thereof.

The terms "or" and "and/or" as used herein are to be interpreted as inclusive or meaning any one or any combination. Therefore, "A, B or C" or "A, B and/or C" mean any of the following: A; B; C; A and B; A and C; B and C; A, B and C." An exception to this definition will occur only when a combination of elements, functions, steps or acts are in some way inherently mutually exclusive.

FIG. 1 depicts a scenario of a user interacting with a smartphone wherein the microphone uses a subset of a microphone array as reference channels for echo cancellation according to one embodiment of the disclosure. The smartphone 101 may include four microphones. Microphones 102, 103, 105, are located at various locations on the front of the smartphone 101. Microphones 102 and 103 are located near the bottom edge close to where a user's mouth is expected to be when the user holds the smartphone 101 next to the ear. Microphone 104 is positioned on the back of the smartphone 101. Microphones 104 and 105 are located on the top edge opposite from microphones 102 and 103 to more easily capture sound coming from the top direction when the user operates the smartphone 101 hand-free. The microphones 102, 103, 104, 105 form a compact microphone array to receive speech signals from the user. For example, a near-end user 110 local to the smartphone 101 may utter a query keyword such as "hey Siri" to request information from a virtual assistant application. Each of the microphones may receive the speech signal with different direction of arrivals (DOA) and different echo and reverberation effects.

One or more loudspeakers may be positioned at various locations on the smartphone 101 to output audio content to a user. For example a loudspeaker may be located near the top edge on the front of the smartphone 101 to be close to where a user's ear is expected to be when the smartphone 101 is held next to the head. A second loudspeaker may be located near the bottom edge for use as part of a speakerphone for a hand-free operation. The loudspeakers may play music, phone conversation, podcast, downloaded audio, synthesized speech, etc., which are collectively referred to as playback content. Microphones 103 and 105 are relative closer to a loudspeaker than microphones 102 and 104. Microphones 103 and 105 thus may have more echo coupling of audio content from the loudspeakers than microphones 102 and 104. As such, microphones 103 and 105 may be used as reference microphones to capture the playback reference signals for estimating the echo signal of the playback content captured by target microphones 102 and 104.

The near-end user 110 may speak such as issuing a voice command while the loudspeakers are playing playback content. An echo canceller running on the smartphone 101 or on another device, such as a server wirelessly connected to the smartphone 101, may process the playback reference signals from microphones 103 and 105 and echo signals of the playback content captured by target microphone 102 to cancel or suppress the echo signals while mitigating potential cancellation of the near-end speech captured by target microphone 102. Similarly, the echo canceller may process the playback reference signals from microphones 103 and 105 and echo signals of the playback content captured by target microphone 104 to cancel or suppress the echo signals while mitigating potential cancellation of the near-end speech captured by target microphone 104. While the operation of the echo canceller will be described using the smartphone 101 as an example, the operation may be practiced on other devices such as desktop computers, laptops, home assistant devices, etc.

Figure 2:
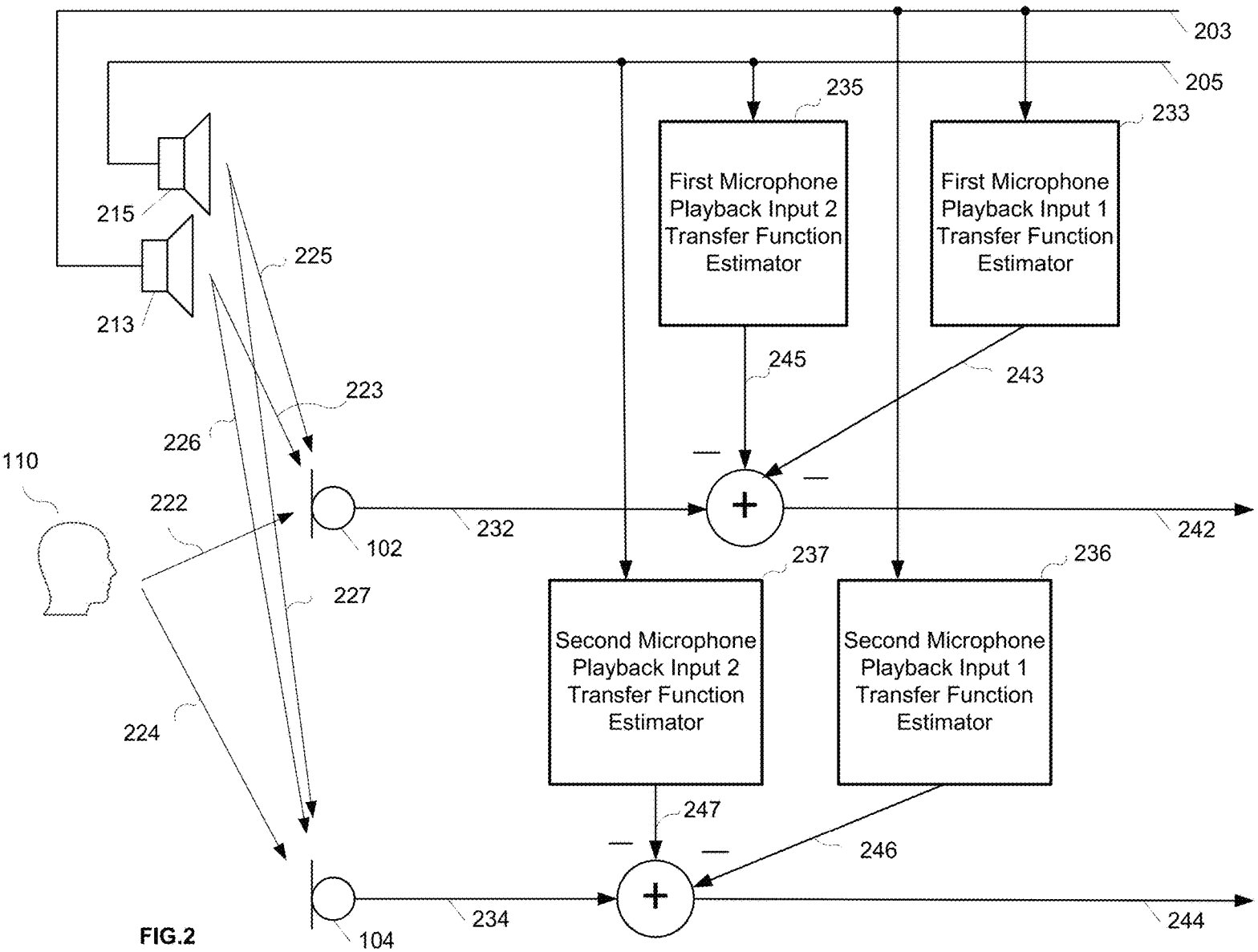
FIG. 2 is a block diagram of an echo canceller that uses loudspeakers of a device as reference channels to estimate the echo signals of audio playback content received by a microphone from the loudspeakers.

FIG. 2 is a block diagram of an echo canceller that uses loudspeakers of a device as reference channels to estimate the echo signals of audio playback content received by a microphone from the loudspeakers. Two loudspeakers 213 and 215 receive playback content 203 and 205, respectively. Playback content 203 and 205 may be the same or may be two channels of the playback content, such as multi-channel stereo music.

Microphone 102 may receive an echo signal 223 of the playback content 203 output by the first loudspeaker 213. The microphone 102 may also receive an echo signal 225 of the playback content 205 output by the second loudspeaker 215. The echo signals 223 and 225 coupled to the microphone 102 may be different because of the different relative distances and positions of the loudspeakers 213 and 215 from the microphone 102 and also because of the different audio characteristics of the loudspeakers 213 and 215. To cancel the echo signals 223 and 225 from the audio signal 232 captured by the microphone 102, an echo canceller estimates the echo components using the playback content 203 and 205 as playback reference signals. For example, first microphone playback input 1 transfer function estimator 233 receives the playback content 203 provided to the first loudspeaker 213 as a playback reference signal to estimate the transfer function or impulse response between the first loudspeaker 213 and the microphone 102. Analogously, first microphone playback input 2 transfer function estimator 235 receives the playback content 205 provided to the second loudspeaker 215 as a playback reference signal to estimate the transfer function or impulse response between the second loudspeaker 215 and the microphone 102. The first microphone playback input 1 transfer function estimator 233 and the first microphone playback input 2 transfer function estimator 235 may receive the audio signal 232 captured by the microphone 102 for the estimates of the transfer functions.

Based on the playback content 203 and the estimated transfer function between the first loudspeaker 213 and the microphone 102, the first microphone playback input 1 transfer function estimator 233 may estimate the echo signal 223 as estimated echo component 243. Analogously, based on the playback content 205 and the estimated transfer function between the second loudspeaker 215 and the microphone 102, the first microphone playback input 2 transfer function estimator 235 may estimate the echo signal 225 as estimated echo component 245. The echo canceller may subtract the estimated echo components 243 and 245 from the audio signal 232 to try to cancel the echo signals 223 and 225 of the playback content captured by the microphone 102. When the near-end user 110 speaks such as issuing a voice command during the playing of the playback content, the echo cancelled signal 242 from the echo canceller may contain the near-end speech signal 222 and some residual echo signals that remain after echo cancellation.

Analogously, microphone 104 may receive an echo signal 226 of the playback content 203 output by the first loudspeaker 213 and an echo signal 227 of the playback content 205 output by the second loudspeaker 215. To cancel the echo signals 226 and 227 from the audio signal 234 captured by the microphone 104, second microphone playback input 1 transfer function estimator 236 receives the playback content 203 to estimate the transfer function or impulse response between the first loudspeaker 213 and the microphone 104 and may estimate the echo signal 226 as estimated echo component 246. Similarly, second microphone playback input 2 transfer function estimator 237 receives the playback content 205 to estimate the transfer function or impulse response between the second loudspeaker 215 and the microphone 104 and may estimate the echo signal 227 as estimated echo component 247. The second microphone playback input 1 transfer function estimator 236 and the second microphone playback input 2 transfer function estimator 237 may receive the audio signal 234 captured by the microphone 104 for the estimates of the transfer functions. The echo canceller may subtract the estimated echo components 246 and 247 from the audio signal 234 to try to cancel the echo signals 226 and 227 of the playback content captured by the microphone 104 and may generate the echo cancelled signal 244.

Voice recognition software may process the echo cancelled signals 242 or 244 to recognition the voice command. However, because the first microphone playback input 1 transfer function estimator 233 and the first microphone playback input 2 transfer function estimator 235 use the playback content 203 and playback content 205 to the loudspeakers 213 and 215, respectively, as playback reference signals, the estimated transfer functions may not capture the nonlinearities of the loudspeakers 213 and 215. Similarly, the estimated transfer functions generated by the second microphone playback input 1 transfer function estimator 236 and the second microphone playback input 2 transfer function estimator 237 may not capture the nonlinearities of the loudspeakers 213 and 215. As a result, significant residual echo signals may remain on the echo cancelled signals 242 or 244, compromising the performance of the voice recognition software.

Figure 3:
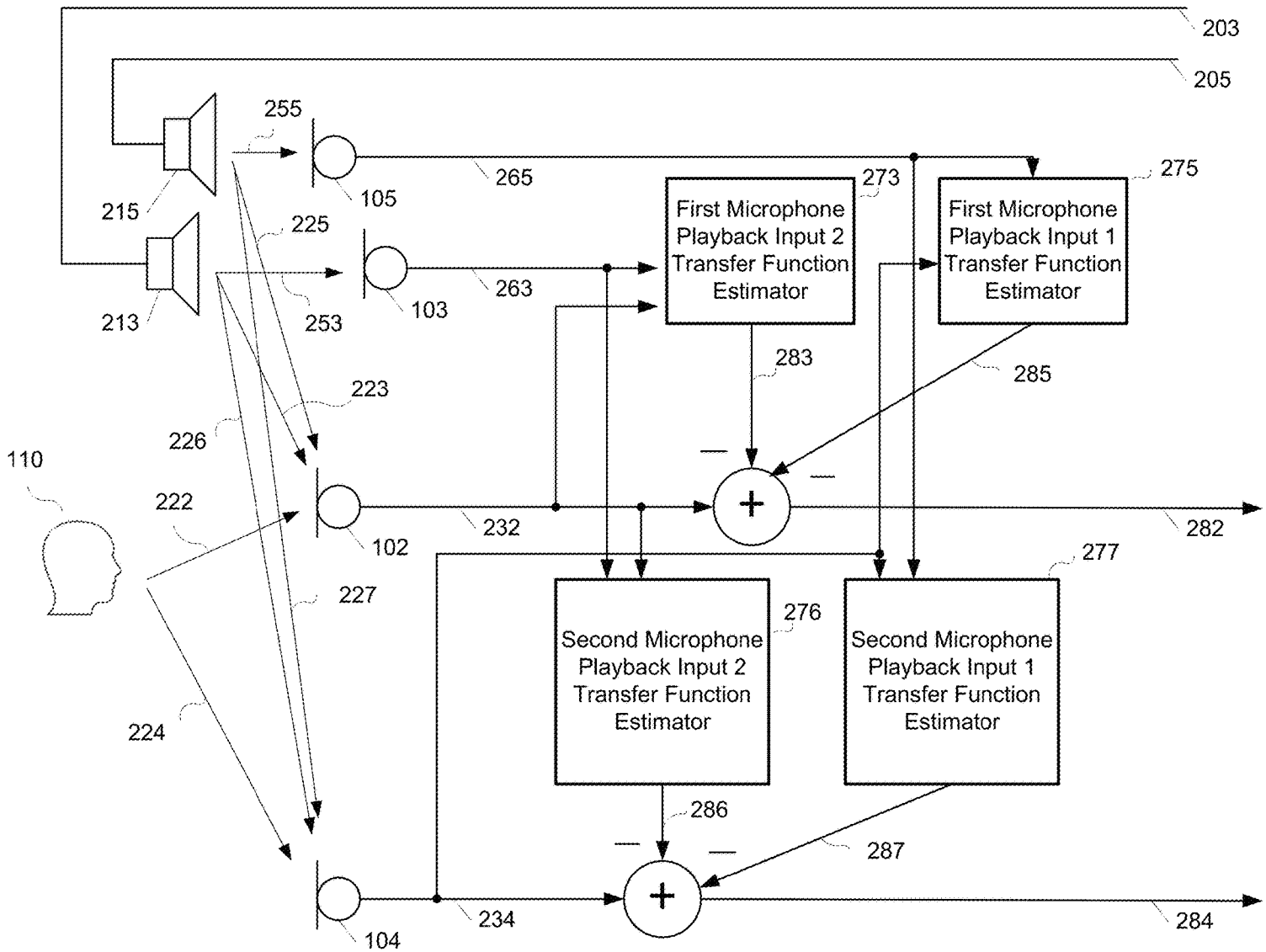
FIG. 3 is a block diagram of an echo canceller that uses a subset of microphones of a device as reference channels to provide playback reference signals to estimate the echo signals of audio playback content received by a target microphone according to one embodiment of the disclosure.

FIG. 3 is a block diagram of an echo canceller that uses a subset of microphones of a device as reference channels to provide playback reference signals to estimate the echo signals of audio playback content received by a target microphone according to one embodiment of the disclosure. As in FIG. 2, first loudspeakers 213 and second loudspeaker 215 receive playback content 203 and 205, respectively. Microphone 102 may receive an echo signal 223 of the playback content 203 output by the first loudspeaker 213 and an echo signal 225 of the playback content 205 output by the second loudspeaker 215. A second microphone, microphone 104, may receive an echo signal 226 of the playback content 203 output by the first loudspeaker 213 and an echo signal 227 of the playback content 205 output by the second loudspeaker 215.

However, unlike FIG. 2, microphones 103 and 105 are used as reference microphones to provide playback reference signals of the playback content 203 and 205, respectively, for echo cancellation. Microphone 103 may be selected as a first reference microphone because it is located relatively close to the first loudspeaker 213 and may be susceptible to residual echo 253 of the playback content 203 from the first loudspeaker 213. Similarly, microphone 105 may be selected as a second reference microphone because it is located relatively close to the second loudspeaker 215 and may be susceptible to residual echo 255 of the playback content 205 from the second loudspeaker 215. The audio signal 263 captured by the first reference microphone 103 may contain the residual echo 253. The audio signal 265 captured by the second reference microphone 105 may contain the residual echo 255.

First microphone reference channel 1 transfer function estimator 273 receives the audio signal 263 captured by the first reference microphone 103 as a playback reference signal to estimate the transfer function or impulse response between the first reference microphone 103 and the microphone 102. Analogously, second microphone reference channel 2 transfer function estimator 277 receives the audio signal 265 captured by the second reference microphone 105 as a playback reference signal to estimate the transfer function or impulse response between the second reference microphone 105 and the microphone 104. The first microphone reference channel 1 transfer function estimator 273 may receive the audio signal 232 captured by the microphone 102 for the estimate of the transfer function. The second microphone reference channel 2 transfer function estimator 277 may receive the audio signal 234 captured by the microphone 104 for the estimate of the transfer function.

Based on the playback reference signal of the audio signal 263 and the estimated transfer function between the first reference microphone 103 and the microphone 102, the first microphone reference channel 1 transfer function estimator 273 may generate estimated echo component 283 as an estimate of the echo signal 223. The echo canceller may subtract the estimated echo components 283 from the audio signal 232 to cancel the echo signal 223 of the playback content captured by the microphone 102. Analogously, based on the playback reference signal of the audio signal 265 and the estimated transfer function between the second reference microphone 105 and the microphone 104, the second microphone reference channel 2 transfer function estimator 277 may generate estimated echo component 287 as an estimate of the echo signal 227. The echo canceller may subtract the estimated echo component 287 from the audio signal 234 to cancel the echo signal 227 of the playback content captured by the microphone 104.

When the near-end user 110 speaks such as issuing a voice command during the playing of the playback content, the audio signal 232 captured by the microphone 102 may contain the near-end speech signal 222. The near-end speech signal 222 may also be captured by the first reference microphone 103 and the second reference microphone 105 such that the playback reference signals of the audio signals 263 and 265 may contain signals of the near-end speech signal 222. The near-end speech signal 222 may also be captured by the microphone 104 and may be designed as signal 224. If the playback reference signals are used to estimate the transfer functions between the reference microphones 103, 105 and the microphone 102, signal cancellation of the near-end speech signal 222 may result. To mitigate the potential near-end speech cancellation, the first microphone reference channel 1 transfer function estimator 273 may compute a discriminator value, referred to as a double-talk mask or simply a mask between a reference microphone-target microphone pair to measure the relative strength of the echo signals 223 and the near-end speech signal 222 captured by the reference microphones 103 and by the target microphone 102. Analogously, the second microphone reference channel 2 transfer function estimator 277 may compute a mask between a reference microphone-target microphone pair to measure the relative strength of the echo signals 227 and the near-end speech signal 224 captured by the reference microphones 105 and by the target microphone 104.

In one embodiment, the mask for the first reference microphone 103 and the target microphone 102 may be computed as:

$$\alpha_k^{103,102} = \frac{|M_k^{103} - M_k^{102}|}{|M_k^{103} + M_k^{102}|} \quad \text{(Eq. 1)}$$

where $\alpha^{103,102}$ represents the mask for the first reference microphone 103 and the target microphone 102 for frequency bin k, $M_k^{103}$ may represent the complex value of the audio signal 263 captured by the first reference microphone 103 for frequency bin k in one embodiment, $M_k^{103}$ may represent the magnitude of the audio signal 263 captured by the first reference microphone 103 for frequency bin k, and $M_k^{102}$ may represent the complex value of the audio signal 232 captured by the target microphone 102 for frequency bin k in one embodiment, $M_0^{102}$ may represent the magnitude of the audio signal 232 captured by the target microphone 102 for frequency bin k.

The mask $\alpha_k^{103,102}$ is computed as the magnitude of the difference between the value of the audio signal 263 captured by the first reference microphone 103 and the value of the audio signal 232 captured by the target microphone 102 normalized by the magnitude of the sum of the values for frequency bin k. When the audio signal 232 captured by the target microphone 102 contains predominantly the echo signal 223 from the first loudspeaker 213, $\alpha_k^{103,102} \approx 1$. On the other hand, when the audio signal 232 captured by the target microphone 102 contains predominantly the near-end speech signal 222, $\alpha_k^{103,102} \approx 0$. The value of the mask $\alpha_k^{103,102}$ thus indicates the relative strength of the echo signal 223 of the playback content from the first loudspeaker 213 and the near-end speech signal 222. The first microphone reference channel 1 transfer function estimator 273 may use mask $\alpha_k^{103,102}$ to adaptively modify the estimation of the transfer function between the first reference microphone 103 and the microphone 102 on a frequency bin basis so as to generate the estimated echo component 283 that does not include the near-end speech signal 222.

In one embodiment, the first microphone reference channel 1 transfer function estimator 273 may implement a multi-delay filter (MDF) to estimate the transfer function between the first reference microphone 103 and the target microphone 102 for a range of frequency bins. The first microphone reference channel 1 transfer function estimator 273 may use mask $\alpha_k^{103,102}$ as a step-size control to adaptively control the updating of the MDF on a frequency bin basis. If mask $\alpha_k^{103,102} \approx 1$, indicating an echo dominant signal for frequency bin k, the first microphone reference channel 1 transfer function estimator 273 may update the transfer function between the first reference microphone 103 and the target microphone 102 to account for the echo signal 223 for frequency k. Alternatively, if $\alpha_k^{103,102} \approx 0$, indicating a near-end speech dominant signal for frequency bin k, the first microphone reference channel 1 transfer function estimator 273 may not update the transfer function between the first reference microphone 103 and the target microphone 102 for frequency k so that the transfer function does not consider the near-end speech signal 222. Component of the near-end speech signal 222 is thus prevented from appearing at the estimated echo component 283 as an estimate of the echo signal 223 to mitigate potential cancellation of the near-end speech signal 222 at the echo-cancelled signal 282.

In one embodiment, the first microphone reference channel 1 transfer function estimator 273 may implement a sub-band lattice filter to estimate the transfer function between the first reference microphone 103 and the target microphone 102 for a range of frequency bins. The lattice filter may calculate forward and backward prediction errors for the playback reference signal of the audio signals 263 captured by the first reference microphone 103. The first microphone reference channel 1 transfer function estimator 273 may use mask $\alpha_k^{103,102}$ to enhance the playback reference signals of the audio signals 263 by removing component of the near-end speech signal 222 from the forward and backward prediction errors for the sub-band lattice filter when $\alpha_k^{103,102} \approx 0$.

For example, the first microphone reference channel 1 transfer function estimator 273 may use mask $\alpha_k^{103,102}$ to modify $M_k^{103}$ as in:

$$\tilde{M}_k^{103} = \alpha_k^{103,102} M_k^{103} \quad \text{(Eq. 2)}$$

where $\hat{M}_k^{103}$ is the modified complex value of the playback reference signal used by the forward and back prediction errors of the sub-band lattice filter to estimate the transfer function between the first reference microphone 103 and the target microphone 102 for frequency bin k. When $\alpha_k^{103,102} \approx 0$, the modified playback reference signal becomes negligible to prevent a component of the near-end speech signal 222 from appearing at the estimated echo component 283 as an estimate of the echo signal 223 to mitigate potential cancellation of the near-end speech signal 222 at the echo-cancelled signal 282. In one embodiment, the sub-band lattice filter may apply the mask $\alpha_k^{103,102}$ on each stage of the lattice update. The result is also to prevent a component of the near-end speech signal 222 from appearing at the estimated echo component 283 as an estimate of the echo signal 223 to mitigate potential cancellation of the near-end speech signal 222.

Analogously, the mask for the second reference microphone 105 and the target microphone 104 may be computed as:

$$\alpha_k^{105,104} = \frac{|M_k^{105} - M_k^{104}|}{|M_k^{105} + M_k^{104}|} \quad \text{(Eq. 3)}$$

where $\alpha_k^{105,104}$ represents the mask for the second reference microphone 105 and the target microphone 104 for frequency bin k, $M_k^{105}$ may represent the complex value of the audio signal 265 captured by the second reference microphone 105 for frequency bin k in one embodiment, $M_k^{105}$ may represent the magnitude of the audio signal 265 captured by the second reference microphone 105 for frequency bin k, and $M_k^{104}$ may represent the complex value of the audio signal 234 captured by the target microphone 104 for frequency bin k, in one embodiment, $M_k^{104}$ may represent the magnitude of the audio signal 234 captured by the target microphone 104 for frequency bin k.

The mask $\alpha_k^{105,104}$ is computed as the magnitude of the difference between the value of the audio signal 265 captured by the second reference microphone 105 and the value of the audio signal 234 captured by the target microphone 104 normalized by the magnitude of the sum of the values for frequency bin k. When the audio signal 234 captured by the target microphone 104 contains predominantly the echo signal 227 from the second loudspeaker 215, $\alpha_k^{105,104} \approx 1$. On the other hand, when the audio signal 234 captured by the target microphone 104 contains predominantly the near-end speech signal 224, $\alpha_k^{105,104} \approx 0$. The value of the mask $\alpha_k^{105,104}$ thus indicates the relative strength of the echo signal 227 of the playback content from the second loudspeaker 215 and the near-end speech signal 224. The second microphone reference channel 2 transfer function estimator 277 may use mask $\alpha_k^{105,104}$ to adaptively modify the estimation of the transfer function between the second reference microphone 105 and the microphone 104 on a frequency bin basis so as to generate the estimated echo component 287 that does not include the near-end speech signal 224.

The first microphone reference channel 1 transfer function estimator 273 and the second microphone reference channel 2 transfer function estimator 277 may compute their respective masks $\alpha_k^{103,102}$ and $\alpha_k^{105,104}$ to independently and adaptively modify their transfer functions and estimated echo components 283 and 287 for echo cancellation of the echo signal 223 from the audio signal 232 captured by the target microphone 102 and echo signal 227 from the audio signal 234 captured by the target microphone 104, respectively, during barge-in of user speech when the loudspeakers 213 and 215 are playing playback content.

In one embodiment, first microphone reference channel 2 transfer function estimator 275 receives the audio signal 265 captured by the second reference microphone 105 as a playback reference signal to estimate the transfer function or impulse response between the second reference microphone 105 and the microphone 102. In one embodiment, the first microphone reference channel 2 transfer function estimator 275 may receive the audio signal 234 captured by the microphone 104 for the estimate of the transfer function, as in the second microphone reference channel 2 transfer function estimator 277. The first microphone reference channel 2 transfer function estimator 275 may use mask $\alpha_k^{105,104}$ to adaptively modify the estimation of the transfer function between the second reference microphone 105 and the microphone 102 on a frequency bin basis, or to modify $M_k^{105}$ used by the transfer function.

Based on the playback reference signal of the audio signal 265 and the estimated transfer function between the second reference microphone 105 and the microphone 102, the first microphone reference channel 2 transfer function estimator 275 may generate estimated echo component 285 as an estimate of the echo signal 225. The echo canceller may subtract the estimated echo components 285 from the audio signal 232 to cancel the echo signal 225 of the playback content captured by the microphone 102. In one embodiment, the first microphone reference channel 2 transfer function estimator 275 may receive the audio signal 232 captured by the microphone 102 and mask $\alpha_k^{103,102}$ for the estimate of the transfer function.

In one embodiment, second microphone reference channel 1 transfer function estimator 276 receives the audio signal 263 captured by the first reference microphone 103 as a playback reference signal to estimate the transfer function or impulse response between the first reference microphone 103 and the microphone 104. In one embodiment, the second microphone reference channel 1 transfer function estimator 276 may receive the audio signal 232 captured by the microphone 102 for the estimate of the transfer function, as in the first microphone reference channel 1 transfer function estimator 273. The second microphone reference channel 1 transfer function estimator 276 may use mask $\alpha_k^{103,102}$ to adaptively modify the estimation of the transfer function between the first reference microphone 103 and the microphone 104 on a frequency bin basis, or to modify $M_k^{103}$ used by the transfer function.

Based on the playback reference signal of the audio signal 263 and the estimated transfer function between the first reference microphone 103 and the microphone 104, the second microphone reference channel 1 transfer function estimator 276 may generate estimated echo component 286 as an estimate of the echo signal 226. The echo canceller may subtract the estimated echo components 286 from the audio signal 234 to cancel the echo signal 226 of the playback content captured by the microphone 104. In one embodiment, the second microphone reference channel 1 transfer function estimator 276 may receive the audio signal 234 captured by the microphone 104 and mask $\alpha_k^{105,104}$ for the estimate of the transfer function.

In one embodiment, for fast initial echo cancellation convergence, the first microphone reference channel 1 transfer function estimator 273 and the second microphone reference channel 2 transfer function estimator 277 may be pre-initialized using anechoic, white noise recordings. For example, the MDF may be initialized with a pre-trained transfer function using white noise recording for a device in a free air environment or a device on a table top to improve the convergence of the initial echo cancellation operation from a cold start.

In one embodiment, echo coupling of different target microphones such as target microphones 102 and 104 may be different due to the microphones' different positions and distances from the loudspeakers and the acoustic environment of the device. For example, when the smartphone 101 of FIG. 1 is set on a table with the front facing up, the target microphone 104 located on the back of the smartphone 101 may experience high echo coupling compared to the target microphone 102. A respective deep neural network-based residual echo cancellation (DNN-REC) system may operate on the echo cancelled signals 282 and 284 from the echo canceller to remove residual echo from target microphones 102 and 104 independently. The DNN-REC system may learn the mapping between the linear echo component estimated by the echo canceller and the non-linear residual echo component of training data during supervised deep learning. Using the learned mapping, the DNN-REC system may estimate the non-linear residual echo component of the playback content captured by the audio signals of the target microphones 102 and 104 based on the linear echo estimation from the echo canceller. The respective DNN-REC system may subtract the estimated non-linear residual echo component of the playback content from the echo cancelled signal 282 and 284 of target microphones 102 and 104, respectively to remove the residual echo signals.

Figure 4:
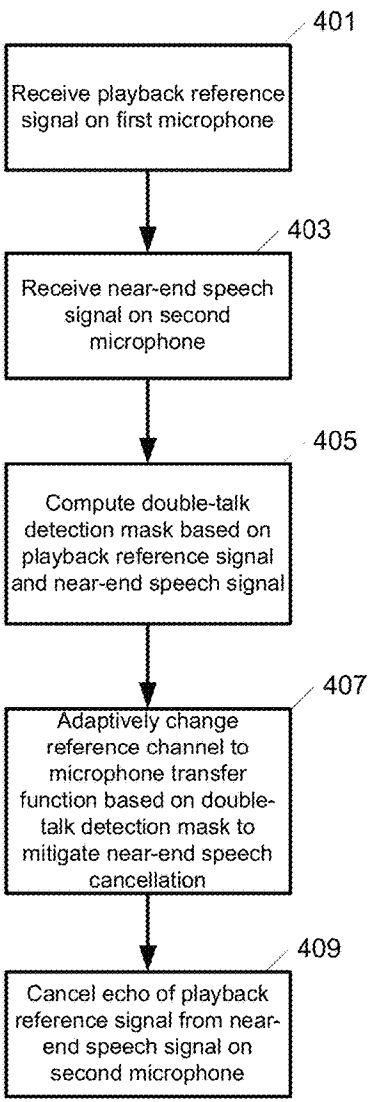
FIG. 4 is a flow diagram of a first method of echo cancellation of audio playback content during barge-in of near-end user speech by adaptively updating the transfer function of a reference microphone-target microphone pair to mitigate near-end speech cancellation in accordance to one embodiment of the disclosure.

FIG. 4 is a flow diagram of a first method of echo cancellation of audio playback content during barge-in of near-end user speech by adaptively updating the transfer function of a reference microphone-target microphone pair to mitigate near-end speech cancellation in accordance to one embodiment of the disclosure. The method may be practiced by the echo canceller of FIG. 3 in conjunction with the smartphone 101.

In operation 401, the method receives the playback reference signal on a first microphone designated as the reference microphone. The reference microphone may be located relatively closer to a loudspeaker than a target microphone of a device. The playback reference signal received by the first microphone may contain the residual echo of playback content played from the loudspeaker.

In operation 403, the method receives the near-end speech signal and an echo signal of the playback reference signal on a second microphone. The second microphone may be referred to as a target microphone. For example, the target microphone may capture an audio signal containing the near-end speech signal component of a user during barge-in and the echo signal component of the playback content from the loudspeaker. The reference microphone may also capture a signal of the near-end speech signal.

In operation 405, the method computes a double-talk detection mask between the reference microphone and the target microphone based on the playback reference signal received by the reference microphone and the audio signal from the target microphone containing the near-end speech signal component and the echo signal component of the playback content. The double-talk detection mask measures the relative strength of the echo signal component of the playback content and the near-end speech signal component captured by the target microphone and the reference microphone.

In operation 407, the method adaptively changes the estimation of the transfer function between the reference microphone and the target microphone based on the double-talk detection mask to mitigate near-end speech cancellation. For example, if the double-talk detection mask indicates that the audio signal of the target microphone is predominantly the echo signal component of the playback content, the method may update the transfer function between the reference microphone and the target microphone. Alternatively, if the double-talk detection mask indicates that the audio signal of the target microphone is predominantly the near-end speech signal component, the method may not update the transfer function between the reference microphone and the target microphone.

In operation 409, the method estimates the echo signal of the playback content received by the target microphone based on the transfer function between the reference microphone and the target microphone and the playback reference signal of the reference microphone, and subtracts the estimated echo signal from the audio signal received by the target microphone to cancel the echo signal of the playback content. The estimated echo signal excludes an estimate of the near-end speech signal component so that the near-end speech signal component is not cancelled from the audio signal received by the target microphone.

Figure 5:
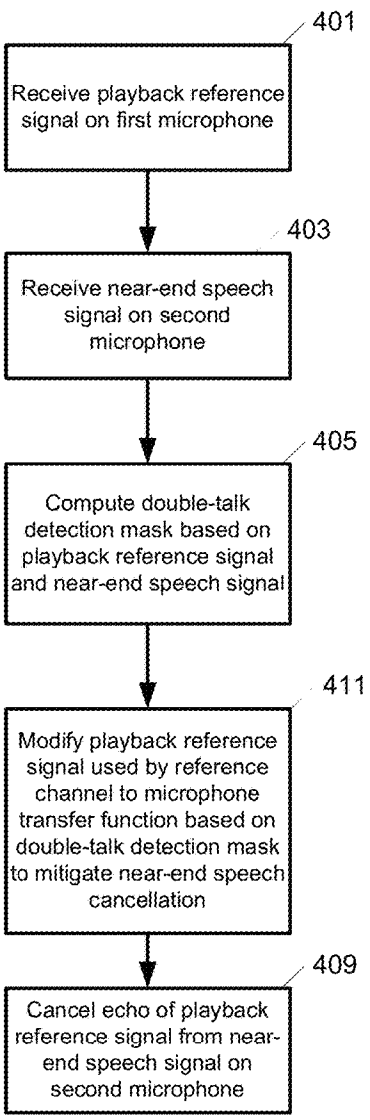
FIG. 5 is a flow diagram of a second method of echo cancellation of audio playback content during barge-in of near-end user speech by modifying the playback reference signal of a reference microphone to mitigate near-end speech cancellation at a target microphone in accordance to one embodiment of the disclosure.

FIG. 5 is a flow diagram of a second method of echo cancellation of audio playback content during barge-in of near-end user speech by adaptively modifying the playback reference signal of a reference microphone to mitigate near-end speech cancellation at a target microphone in accordance to one embodiment of the disclosure. The method may be practiced by the echo canceller of FIG. 3 in conjunction with the smartphone 101. Operations 401, 403, 405, and 409 are the same as those described for FIG. 4, and details of these operations will not be repeated for sake of brevity.

In operation 411, the method modifies the playback reference signal captured by the reference microphone based on the double-talk detection mask. For example, if the double-talk detection mask indicates that the audio signal of the target microphone is predominantly the echo signal component of the playback content, the method may not modify the playback reference signal. Alternatively, if the double-talk detection mask indicates that the audio signal of the target microphone is predominantly the near-end speech signal component, the method may modify the playback reference signal so the playback reference signal is negligible to prevent a component of the near-end speech signal component from appearing as a component of the estimated echo signal of the playback reference signal so as to mitigate near-end speech cancellation. The modified playback reference signal is used by an estimated transfer function between the reference microphone and the target microphone to estimate of the echo signal of the playback content received by the target microphone.

Embodiments of the echo cancellation system described herein may be implemented in a data processing system, for example, by a network computer, network server, tablet computer, smartphone, laptop computer, desktop computer, other consumer electronic devices or other data processing systems. In particular, the operations described for the echo canceller are digital signal processing operations performed by a processor that is executing instructions stored in one or more memories. The processor may read the stored instructions from the memories and execute the instructions to perform the operations described. These memories represent examples of machine readable non-transitory storage media that can store or contain computer program instructions which when executed cause a data processing system to perform the one or more methods described herein. The processor may be a processor in a local device such as a smartphone, a processor in a remote server, or a distributed processing system of multiple processors in the local device and remote server with their respective memories containing various parts of the instructions needed to perform the operations described.

While certain exemplary instances have been described and shown in the accompanying drawings, it is to be understood that these are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A method of performing echo cancellation, the method comprising:

receiving a reference audio signal, produced by a reference microphone of a device, that is responsive to sound from a loudspeaker of the device;

receiving a target audio signal, produced by a first target microphone of the device, that is responsive to an echo of the sound from the loudspeaker and to speech from a speech source;

determining a mask based on the reference audio signal and the target audio signal, wherein the mask is a measure of a relative strength of the reference audio signal and the target audio signal;

adaptively estimating a transfer function between the reference microphone and a second target microphone based on the mask, the reference audio signal, and the target audio signal, the second target microphone producing an audio signal that is responsive to the echo of the sound from the loudspeaker and the speech from the speech source;

determining an estimated echo component of the sound from the loudspeaker based on the estimated transfer function and the reference audio signal; and cancelling the estimated echo component from the audio signal produced by the second target microphone to generate an echo-cancelled signal.

2. The method of claim 1, wherein the reference audio signal comprises a signal component of the sound from the loudspeaker and a signal component of the speech from the speech source when the speech from the speech source is contemporaneous with the sound from the loudspeaker.

3. The method of claim 1, wherein the target audio signal comprises a signal component of the speech from the speech source and an echo component of the sound from the loudspeaker when the speech from the speech source is contemporaneous with the sound from the loudspeaker.

4. The method of claim 1, wherein the mask comprises a magnitude of a difference of a value of the reference audio signal and a value of the target audio signal normalized by a magnitude of a sum of the value of the reference audio signal and the value of the target audio signal.

5. The method of claim 4, wherein the mask approaches 1 when an echo component of the sound from the loudspeaker in the target audio signal is dominant over a signal component of the speech from the speech source in the target audio signal.

6. The method of claim 4, wherein the mask approaches 0 when a signal component of the speech from the speech source in the target audio signal is dominant over an echo component of the sound from the loudspeaker in the target audio signal.

7. The method of claim 1, wherein adaptively estimating the transfer function between the reference microphone and the second target microphone based on the mask, the reference audio signal, and the target audio signal comprises updating an estimate of the transfer function when the mask indicates that an echo component of the sound from the loudspeaker in the target audio signal is dominant over a signal component of the speech from the speech source in the target audio signal.

8. The method of claim 1, wherein adaptively estimating the transfer function between the reference microphone and the second target microphone based on the mask, the reference audio signal, and the target audio signal comprises preventing updating an estimate of the transfer function when the mask indicates that a signal component of the speech from the speech source in the target audio signal is dominant over an echo component of the sound from the loudspeaker in the target audio signal.

9. The method of claim 1, further comprising initializing the transfer function between the reference microphone and the second target microphone using anechoic, white noise recordings.

10. The method of claim 1, wherein the echo-cancelled signal comprises a non-linear residual echo component of the sound from the loudspeaker, wherein the method further comprises operating on the echo-cancelled signal, by a deep learning echo cancellation system, to remove the non-linear residual echo component from the echo-cancelled signal.

11. The method of claim 1, wherein the first target microphone and the second target microphone are different.

12. The method of claim 1, wherein the first target microphone and the second target microphone are the same.

13. A method of performing echo cancellation, the method comprising:

receiving a reference audio signal, produced by a reference microphone of a device, that is responsive to sound from a loudspeaker of the device;

receiving a target audio signal, produced by a target microphone of the device, that is responsive to an echo of the sound from the loudspeaker and to speech from a speech source;

determining a mask based on the reference audio signal and the target audio signal, wherein the mask is a measure of a relative strength of the reference audio signal and the target audio signal;

modifying the reference audio signal based on the mask to generate a modified reference audio signal;

adaptively estimating a transfer function between the reference microphone and the target microphone based on the modified reference audio signal and the target audio signal;

determining an estimated echo component of the sound from the loudspeaker based on the estimated transfer function and the modified reference audio signal; and cancelling the estimated echo component from the target audio signal to generate an echo-cancelled signal.

14. The method of claim 13, wherein the mask comprises a magnitude of a difference of a value of the reference audio signal and a value of the target audio signal normalized by a magnitude of a sum of the value of the reference audio signal and the value of the target audio signal.

15. The method of claim 13, wherein the mask approaches 1 when an echo component of the sound from the loudspeaker in the target audio signal is dominant over a signal component of the speech from the speech source in the target audio signal.

16. The method of claim 13, wherein the mask approaches 0 when a signal component of the speech from the speech source in the target audio signal is dominant over an echo component of the sound from the loudspeaker in the target audio signal.

17. The method of claim 13, wherein the modifying the reference audio signal based on the mask to generate a modified reference audio signal comprises driving the modified reference audio signal toward 0 when the mask indicates that a signal component of the speech from the speech source in the target audio signal is dominant over an echo component of the sound from the loudspeaker in the target audio signal.

18. A system, comprising:

a loudspeaker;

a plurality of microphones, wherein a reference microphone of the plurality of microphones is configured to produce a reference audio signal that is responsive to sound from the loudspeaker, and a target microphone of the plurality of microphones is configured to produce a target audio signal that is responsive to an echo of the sound from the loudspeaker and to speech from a speech source;

a processor; and a memory coupled to the processor to store instructions, which when executed by the processor, cause the processor to:

determine a mask based on the reference audio signal and the target audio signal, wherein the mask is a measure of a relative strength of the reference audio signal and the target audio signal;

adaptively estimate an estimated echo component of the sound from the loudspeaker based on the mask, the reference audio signal, and the target audio signal; and cancel the estimated echo component from the target audio signal to generate an echo-cancelled signal.

19. The system of claim 18, wherein the mask comprises a magnitude of a difference of a value of the reference audio signal and a value of the target audio signal normalized by a magnitude of a sum of the value of the reference audio signal and the value of the target audio signal.

20. The system of claim 19, wherein the mask approaches 1 when an echo component of the sound from the loudspeaker in the target audio signal is dominant over a signal component of the speech from the speech source in the target audio signal.

21. The system of claim 19, wherein the mask approaches 0 when a signal component of the speech from the speech source in the target audio signal is dominant over an echo component of the sound from the loudspeaker in the target audio signal.

22. The system of claim 18, wherein the processor is caused to adaptively estimate an estimated echo component of the sound from the loudspeaker based on the mask, the reference audio signal, and the target audio signal comprises:

the processor is caused to update an estimate of a transfer function between the reference microphone and the target microphone when the mask indicates that an echo component of the sound from the loudspeaker in the target audio signal is dominant over a signal component of the speech from the speech source in the target audio signal; and the processor is caused to prevent an updating of an estimate of the transfer function between the reference microphone and the target microphone when the mask indicates that a signal component of the speech from the speech source in the target audio signal is dominant over an echo component of the sound from the loudspeaker in the target audio signal.

* * * * *